US009613768B2

(12) United States Patent
Tallone et al.

(10) Patent No.: US 9,613,768 B2
(45) Date of Patent: Apr. 4, 2017

(54) SINGLE PUSHBUTTON CONTROL DEVICE FOR A PLURALITY OF SWITCHES

(71) Applicant: BITRON SPA, Rossana (CN) (IT)

(72) Inventors: Fabio Tallone, Frassino (IT); Massimo Perino, Rossana (IT)

(73) Assignee: BITRON S.P.A., Turin (TO) (IT)

( * ) Notice: Subject to any disclaimer, the term of this patent is extended or adjusted under 35 U.S.C. 154(b) by 108 days.

(21) Appl. No.: 14/423,912

(22) PCT Filed: Aug. 29, 2013

(86) PCT No.: PCT/IB2013/058117
§ 371 (c)(1),
(2) Date: Feb. 25, 2015

(87) PCT Pub. No.: WO2014/033659
PCT Pub. Date: Mar. 6, 2014

(65) Prior Publication Data

US 2015/0228424 A1 Aug. 13, 2015

(30) Foreign Application Priority Data

Aug. 30, 2012 (IT) ..... TO2012A0749

(51) Int. Cl.
*H01H 1/10* (2006.01)
*H01H 13/14* (2006.01)
(Continued)

(52) U.S. Cl.
CPC ..... *H01H 13/14* (2013.01); *H01H 13/04* (2013.01); *H01H 13/10* (2013.01); *H01H 13/28* (2013.01);
(Continued)

(58) Field of Classification Search
CPC ..... H01H 2025/048; H01H 13/50; H01H 23/205; H01H 13/705; G05G 2009/04744
(Continued)

(56) References Cited

U.S. PATENT DOCUMENTS 4,761,522 A * 8/1988 Allen ..... B41J 5/28 200/5 R
4,931,606 A * 6/1990 Bruner ..... H01H 13/705 200/341
(Continued)

FOREIGN PATENT DOCUMENTS

| | | |
|---|---|---|
| EP | 1 294 001 | 3/2003 |
| GB | 1 381 729 | 1/1975 |
| IT | TO20100636 A1 | 1/2012 |

OTHER PUBLICATIONS

International Search Report for International Application No. PCT/IB2013/058117 mailed Jan. 27, 2014 (2 pages).

*Primary Examiner* — Vanessa Girardi
(74) *Attorney, Agent, or Firm* — Merchant & Gould P.C.

(57) ABSTRACT

A switch control device includes at least one silicone dome (7) and at least one actuator (5) acting upon the at least one silicone dome (7), which is adapted to close and selectively open electric contacts of at least one switch (6). The actuator (5) is moved by a force exerted via a thrusting element (3). Between the thrusting element (3) and the at least one actuator (5) is at least one elastic element (4) adapted to be compressed by the thrusting element (3) as the at least one silicone dome (7) is compressed, and to extend as the at least one dome (7) collapses towards the switch (6).

15 Claims, 8 Drawing Sheets

(51) Int. Cl.
*H01H 13/28* (2006.01)
*H01H 13/04* (2006.01)
*H01H 13/10* (2006.01)
*H01H 13/26* (2006.01)

(52) U.S. Cl.
CPC ..... *H01H 13/26* (2013.01); *H01H 2215/018* (2013.01); *H01H 2215/034* (2013.01); *H01H 2221/002* (2013.01); *H01H 2221/024* (2013.01); *H01H 2221/044* (2013.01)

(58) Field of Classification Search
USPC ..... 200/513, 517, 17 R, 18
See application file for complete search history.

(56) References Cited

U.S. PATENT DOCUMENTS

| | | | | |
|---|---|---|---|---|
| 5,247,143 | A * | 9/1993 | Suwa | H01H 13/705 200/344 |
| 5,512,722 | A * | 4/1996 | Ozeki | H01H 13/705 200/290 |
| 2002/0027062 | A1 | 3/2002 | Shibutani et al. | |
| 2011/0108403 | A1 | 5/2011 | Kukita | |

* cited by examiner

SINGLE PUSHBUTTON CONTROL DEVICE FOR A PLURALITY OF SWITCHES

This application is a National Stage Application of PCT/IB2013/058117, filed 29 Aug. 2013, which claims benefit of Serial No. TO2012A000749, filed 30 Aug. 2012 in Italy and which applications are incorporated herein by reference. To the extent appropriate, a claim of priority is made to each of the above disclosed applications.

BACKGROUND

The invention relates to a switch control device with silicone domes.

The main types of switch systems currently used in the automotive field can be summarized as follows:

- switches with quick-snap metal foils;
- switches with silicone bubbles and on-board contact;
- switches with silicone bubbles and metal contact integral with the electronic circuit;
- switches with snap-type metal domes that can be actuated either directly or via a silicone intermediary.
- external switch actuated by means of an actuating means and silicone domes.

These different types of operating principles have definite intrinsic characteristics both mechanically, e.g. forces, travels and noise, and electrically, such that in some cases they cannot meet the new requirements of the automotive world.

In particular, the use of external monolithic switches for opening and closing electric circuits introduces an uncertain variable into the determination of the contact or switching point of the switch itself.

Moreover, external switches have intrinsic mechanical characteristics that must be duly taken into account in order to obtain the feeling characteristics required in the automotive field.

For the purposes of the present invention, the term "external switch" refers to a monolithic solid-state switch comprising an outer casing and a push-button, which is electrically connected to a printed circuit board. The control device acts upon said external switch.

For the purposes of the present invention, the term "feeling" refers to the force and displacement perceived by the user as he/she operates a key of a push-button that includes a switch.

Switch control devices are known, such as, for example, the one described in patent application ITTO20100636 by Bitron, wherein, for closing a switch, e.g. comprising conductive elements or silicone domes, the control device comprises a metal foil adapted to create an elastic lever to modify the force/displacement response of the device with respect to the intrinsic characteristic of a silicone dome, for the purpose of accelerating the response of the switch and ensure the proper commutation of the switch.

The solution described in the above-mentioned patent is difficult to implement for actuating an external switch.

SUMMARY

The present invention aims at solving the above-mentioned problems by providing a switch control device that can adapt itself to any type of implemented switch, thus ensuring the desired feeling in response to actuation.

The device that will be described below has been conceived in order to create a family of switches having a switch actuating and closing system that allows to attain force/displacement characteristics meeting the new requirements of the market, while at the same time optimizing the electric performance.

The new device also aims at exploiting some elastic properties of silicone in order to attain new results in terms of feeling and noise, without however increasing the number of components or degrading the electric aspects of the switch.

BRIEF DESCRIPTION OF THE DRAWINGS

The features and advantages of the device according to the present invention will become apparent from the following description of different embodiments thereof and from the annexed drawings, wherein:

FIG. 1A shows the device in the idle condition, FIG. 1B shows the device in the loading condition, FIG. 1C shows the device in the switching operating condition;

DETAILED DESCRIPTION

Figure 1A:
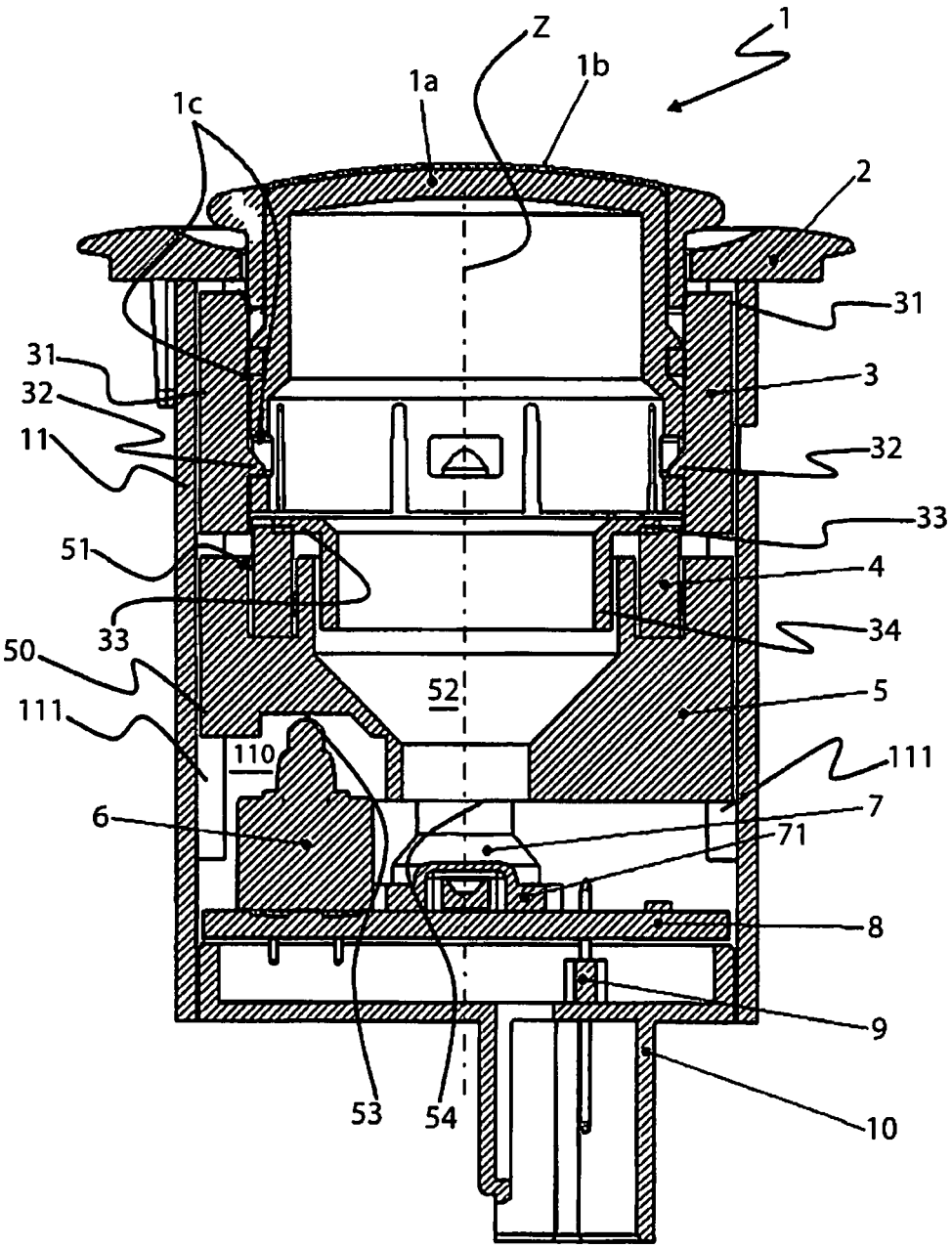
FIGS. 1A, 1B and 1C show a cross-section of a push-button comprising the device according to the present invention in different operating configurations; in particular.

With reference to the above-mentioned drawings, the switch control device comprises: at least one silicone dome 7 and at least one actuating means 5, acting upon said at least one silicone dome 7.

Said at least one actuating means 5 is adapted to close and selectively open electric contacts of at least one switch 6.

Said at least one actuating means 5 is moved by a force exerted through a thrusting means 3. Said force exerted through said one thrusting means 3 is preferably parallel to a vertical axis "Z", more preferably coinciding with the vertical axis of the push-button equipped with the device according to the present invention.

Between said one thrusting means 3 and said at least one actuating means 5 there is at least one elastic means 4 adapted to be compressed by said thrusting element 3 as said at least one silicone dome 7 is compressed, and to extend as said at least one silicone dome 7 collapses towards said switch 6.

Preferably, the control device according to the present invention extends substantially vertically along said axis "Z" and, in particular, the actuating means 5 is located on top of said silicone dome 7. The thrusting means 3, in its turn, is arranged on top of the actuating means 5. As aforementioned, between the actuating means 5 and the thrusting means 3 there is the elastic means 4.

In the preferred embodiment, the device according to the present invention is applicable to a push-button comprising a key 1, which is adapted to be pressed by the user, and a supporting structure 11, which defines a cavity 110 where the device of the present invention is arranged, as shown in the annexed drawings.

In the non-limiting solution illustrated herein, said key 1 comprises a central element 1*a*, on which there is a cover 1*b* where, for example, there is an indication of the function of the push-button. Said key 1 is surrounded by an external covering element 2, which is adapted to cover the point of connection of the push-button in the vehicle or boat. The external element 2 is constrained to said supporting structure 11, e.g. through locator-type or bayonet-type fastening means.

Said key 1 is integral with said thrusting means 3, thus transmitting to the thrusting means 3 the force exerted on the key 1, for the purpose of moving the actuating means 5 and switching the switch 6.

Said thrusting means 3 is secured to the key 1, preferably to the central element 1*a*, through locator-type or bayonet-type fastening means. In the preferred embodiment, said thrusting means 3 comprises at least one fastening portion 32 adapted to be inserted into at least one recess comprised in said central element 1*a* of the key 1.

In the preferred embodiment, said at least one elastic means 4 is made of silicone, preferably with elastic characteristics similar to a silicone mat 71 comprising said silicone dome 7.

Said at least one elastic means 4 has a circular shape, preferably a ring-like shape, e.g. with a parallelogram section.

In alternative embodiments not shown, said elastic means 4 is at least one coil spring, or at least one elastic metal beam, or at least one elastic beam made of plastic material.

In the non-limiting embodiment illustrated herein, both the thrusting means 3 and the actuating means 5 have a substantially cylindrical shape. In the preferred embodiment, also the elements comprised in the push-button, such as the key 1 and the supporting structure 11, have a cylindrical structure.

In the preferred embodiment, said elastic means 4 is a ring having a rectangular cross-section.

Preferably, said at least one elastic means 4 is positioned in a housing 51 comprised in the actuating means 5.

Preferably, said housing 51 has a section which is substantially similar to the section of said elastic means 4, so as to avoid any movement of the elastic means 4 in undesired directions. In particular, the shape of the housing 51 is such that the elastic element 4 cannot move along directions which are not parallel to a vertical axis "Z", and such that it can expand as the same elastic means 4 is compressed.

The thrusting means 3 comprises a striker portion 33 for striking against the elastic means 4 when the device according to the present invention is assembled.

Figure 2:
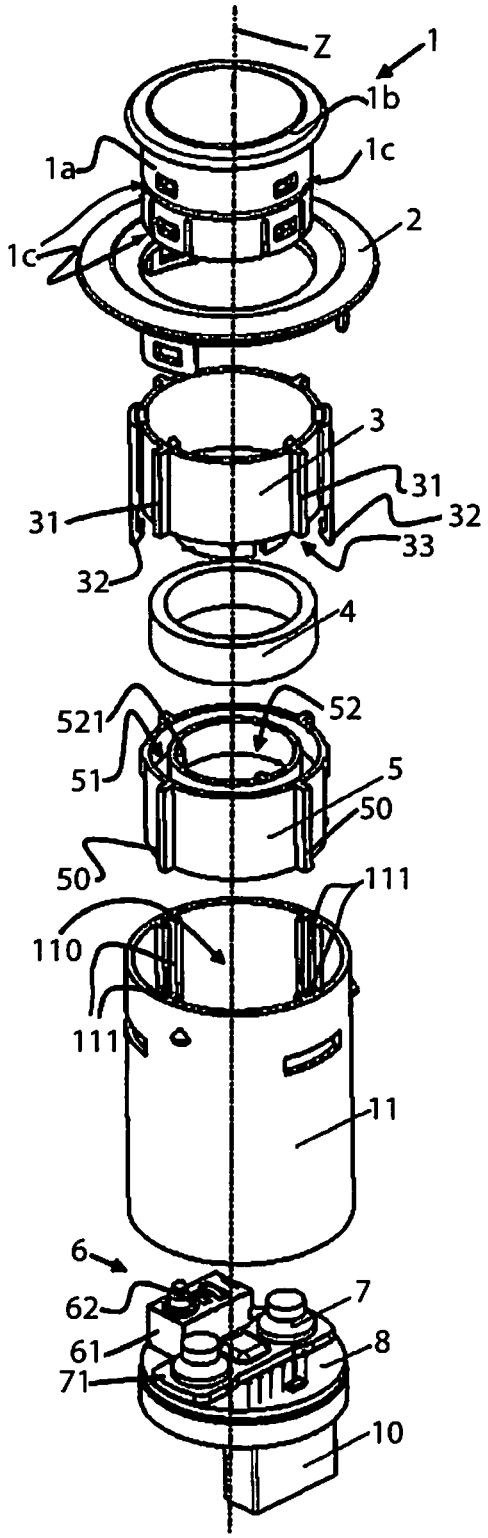
FIG. 2 is an exploded view of the push-button of FIGS. 1A-1C.
Figure 3:
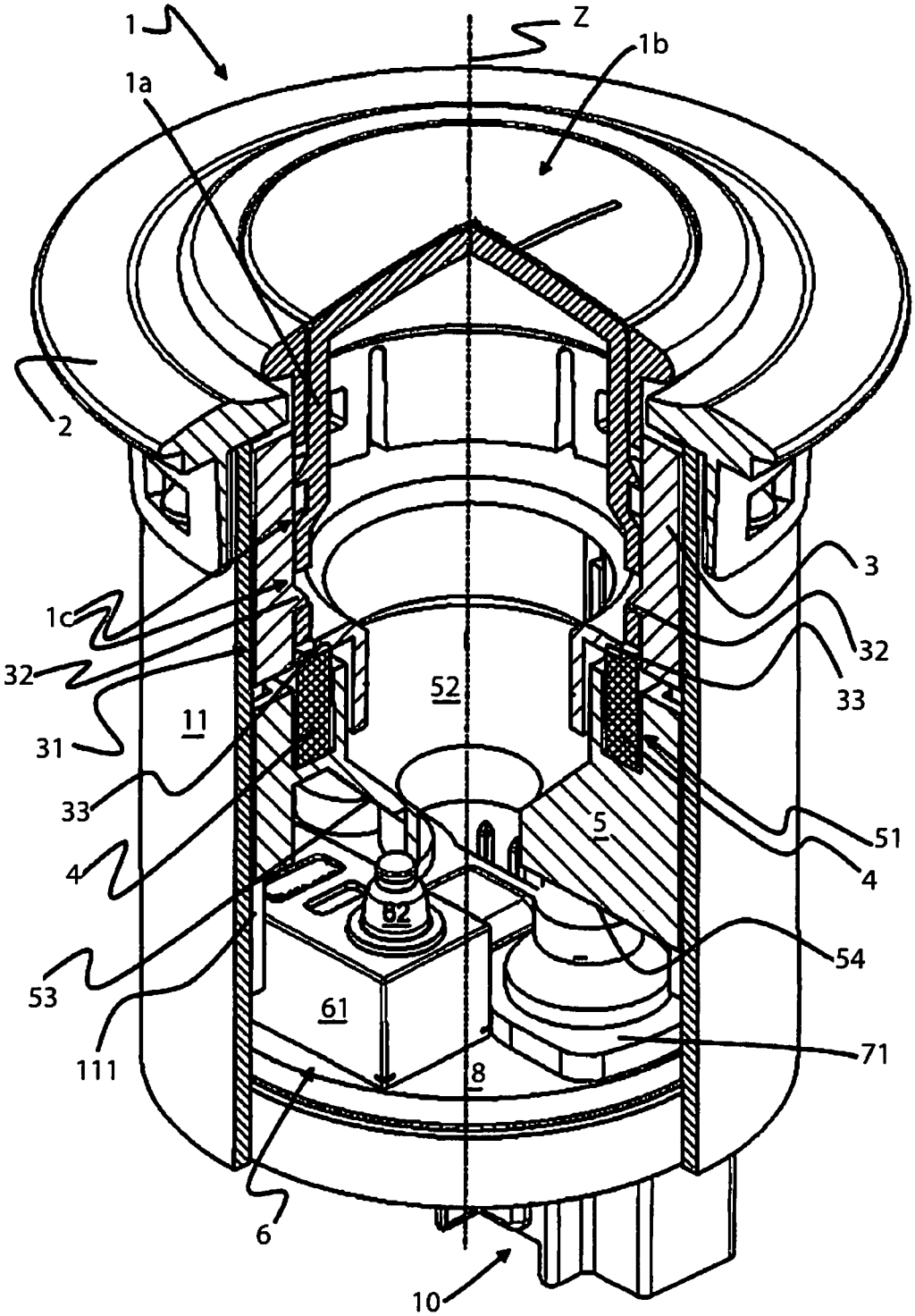
FIG. 3 shows a section of the push-button comprising the control device according to the present invention.

As shown in FIG. 2, the elastic means 4, which is interposed between said actuating means 5 and said thrusting means 3, is shaped like a ring having a rectangular cross-section.

In an idle operating configuration of the device of the present invention, the elastic means 4 keeps the thrusting means 3 and the actuating means 4 at a distance from each other. In the idle operation configuration, said elastic means 4 acts as a spacer between said thrusting means 3 and said actuating means 5.

Said thrusting means 3 comprises first guides 31. Said first guides 31 are adapted to slide along rails 111 comprised in the internal cavity 110 defined by the supporting structure 11.

Said actuating means 5 comprises second guides 50 adapted to slide along said rails 111 comprised in the cavity 110.

In the preferred embodiment, said cavity 110 has a circular section and comprises four equidistant rails 111.

Due to the presence of said first and second guides (31, 50) slideable along said rails 111, only the vertical component of an applied force can move the thrusting means 3, thus causing the actuating means 5 to act upon the switch 6.

In order to ensure the correct positioning of the thrusting means 3 relative to said actuating means 5, the actuating means 5 comprises centering means 521 adapted to interact with said thrusting means 3. In the preferred embodiment, said centering means 521 are comprised in a cavity 52 comprised in the central portion of the actuating means 5.

More in detail, said cavity 52 is a tapered hole, the largest diameter of which is smaller than the diameter of the housing 51.

In the preferred embodiment, said switch 6 is external and is a separate, monolithic, solid-state electric device. Said switch comprises an outer casing 61 and a push-button 62. The switch 6 is preferably a switch having dual independent contacts.

Said switch 6 is electrically connected by soldering to a printed circuit board 8. The same printed circuit board 8 is electrically connected to a connector 10 via suitable pins 9. Said connector 10 is adapted to connect the push-button to the electric circuit of the vehicle or boat in which the push-button has been installed. Said connector 10 is secured to the bottom end of the supporting structure 11, opposite to the end where the key 1 is located.

On said printed circuit board 8, a silicone mat 70 is positioned which comprises at least one silicone dome 7.

Figure 5A:
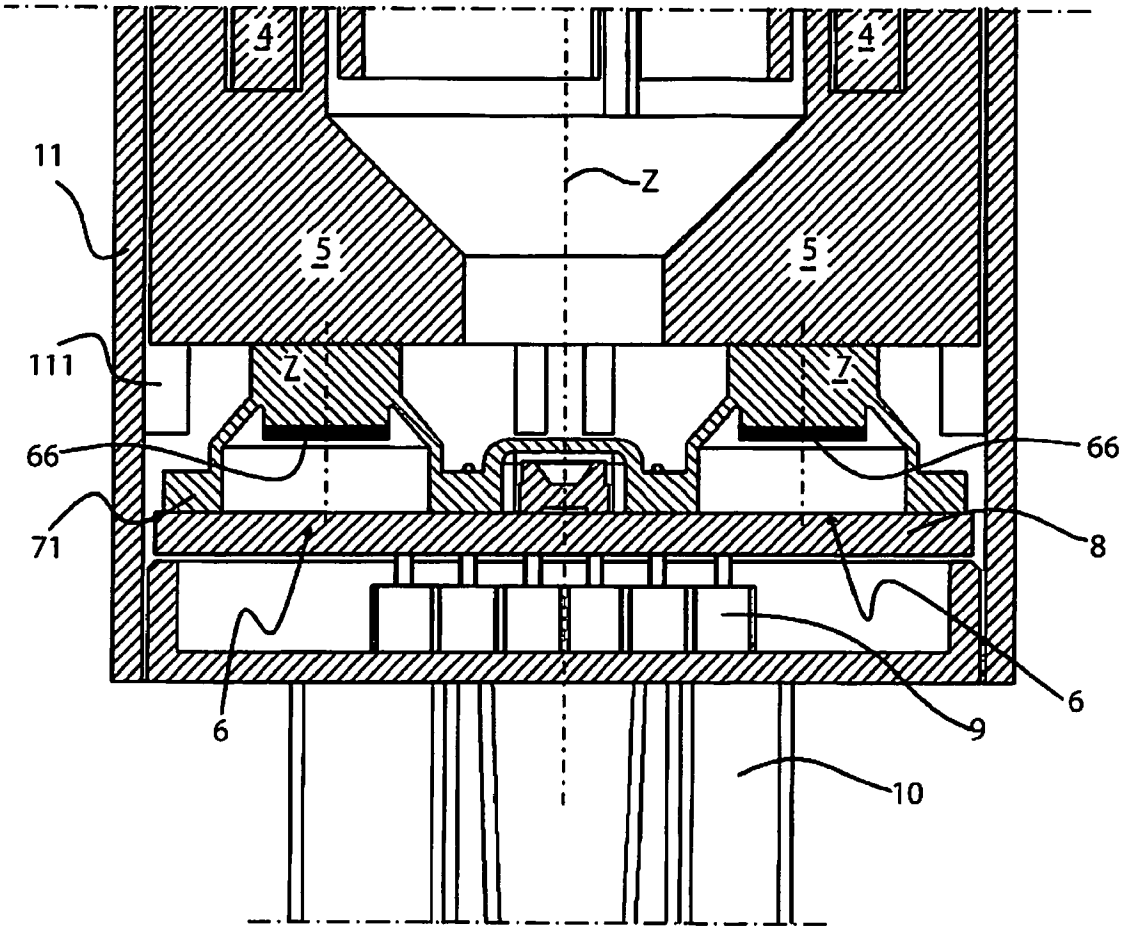
FIGS. 5A and 5B show two different embodiments of the switch controlled by the device according to the present invention.
Figure 5B:
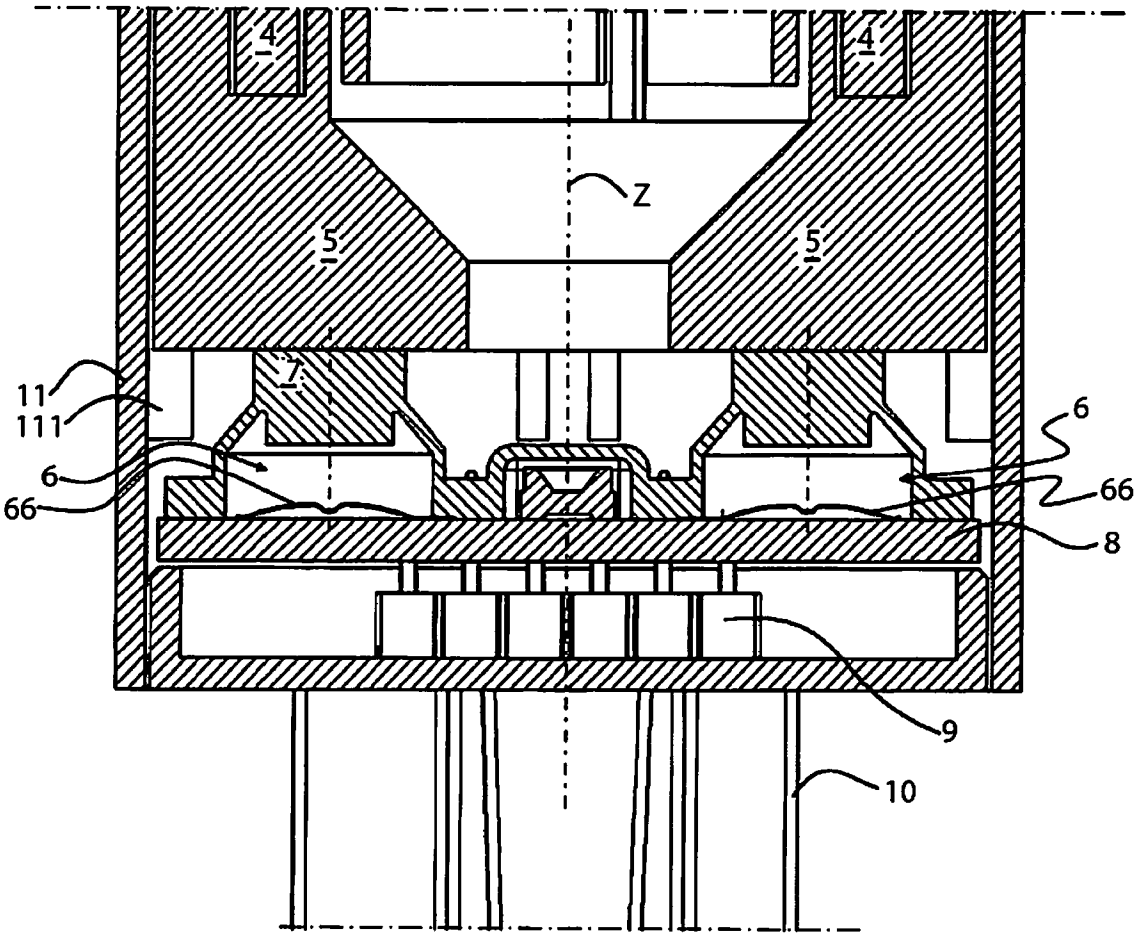

In alternative embodiments, shown in FIGS. 5A and 5B, the switch 6 is integrated into the control device according to the present invention; in particular, it is comprised into a silicone dome 7. In such embodiments, the silicone dome in turn comprises at least one conductive portion 66 for closing an electric circuit included in the printed circuit board 8 when the same dome 7 collapses onto the printed circuit board 8.

In different embodiments (not shown), said conductive portion 66 is a metal foil associated with the dome 7, as shown in FIG. 5A, or possibly interposed between the dome 7 and the printed circuit board 8, as shown in FIG. 5B.

Figure 1B:
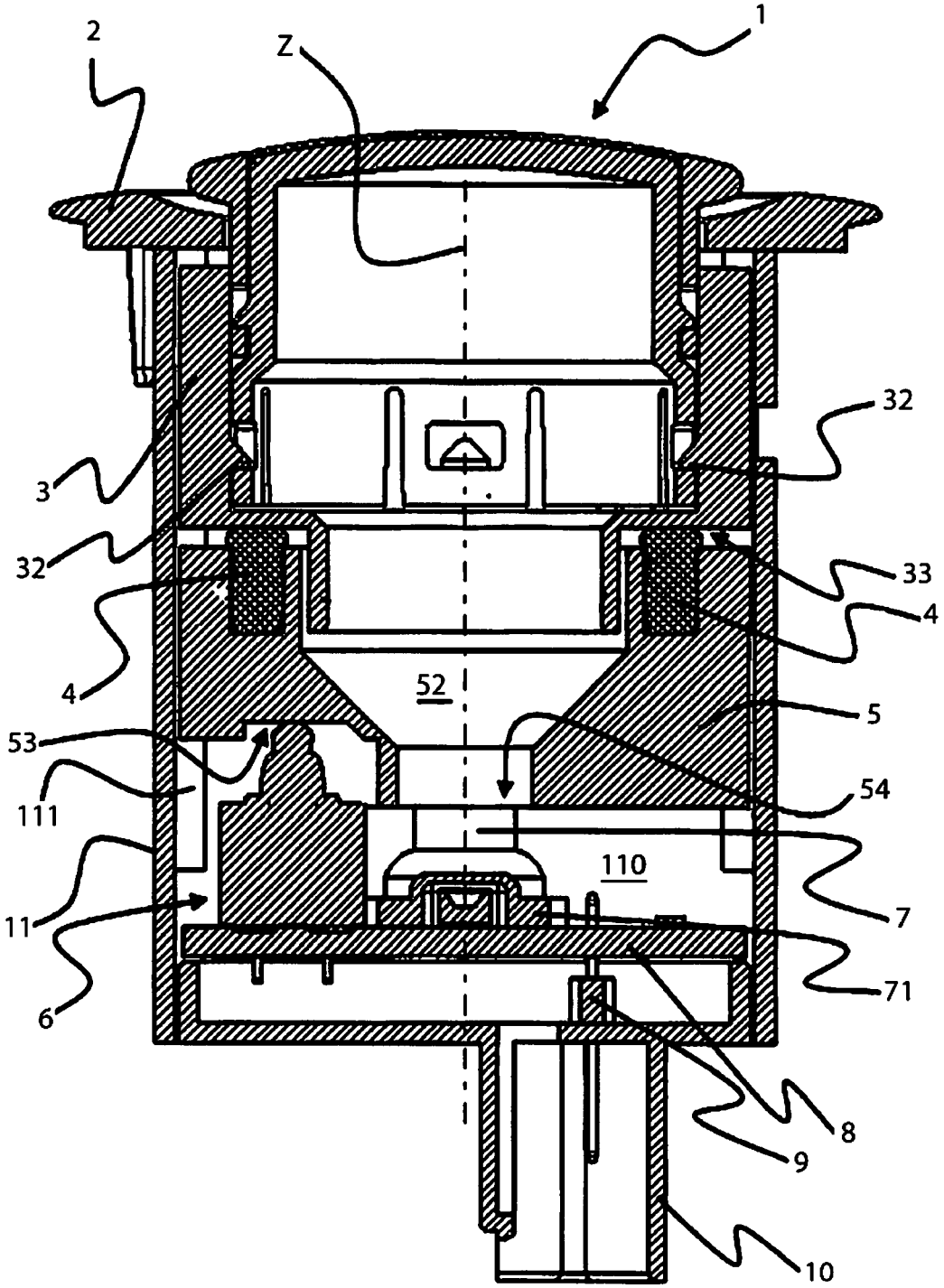
Figure 1C:
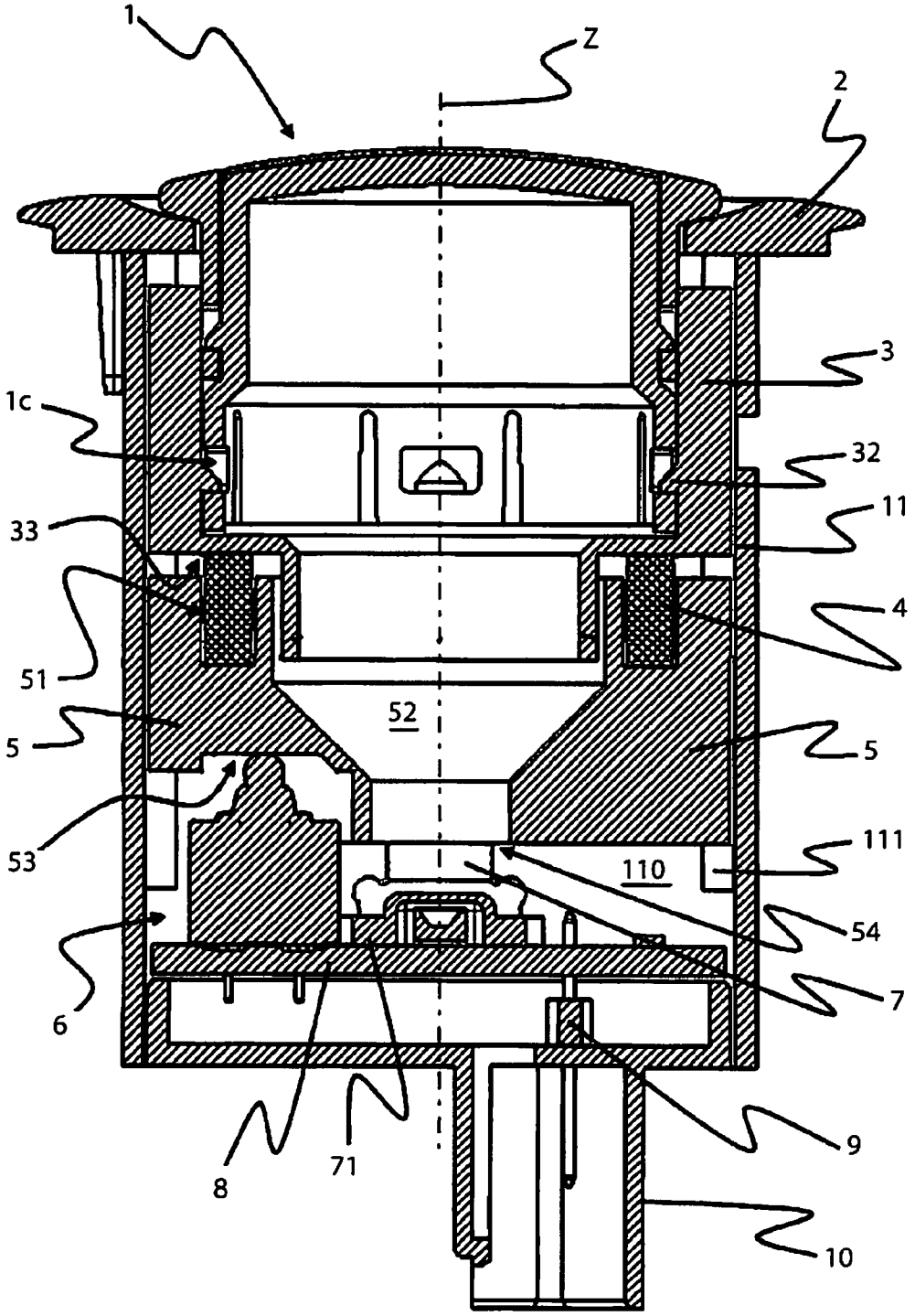

The switch control device can take three operating configurations, in particular:

- an idle operating configuration, wherein no forces are exerted on the thrusting means 3, e.g. through the key 1, as shown in FIG. 1A;
- a switching operating configuration, wherein, following the exertion of a force on said thrusting means 3, the actuating means 5 causes the contacts of the switch 6 to change over, switching from open to closed or vice versa, as shown by way of example in FIG. 1C, and
- a loading operating configuration, taken by the device during the transition from the idle operating configuration to the switching operating configuration, as shown in FIG. 1B.

In the idle operating configuration, all means included in the control device of the present invention are in an extended configuration; in particular, the silicone dome 7 is raised and the elastic means 4 is extended. The extension of the elastic means 4 creates an interspace between the actuating means 5 and the thrusting means 3, such that the two means (5, 3) are kept spaced apart as shown in FIG. 1A.

The gravity forces exerted on the silicone dome 7 by the means (3, 5) are such that they will not cause the dome 7 to collapse. For these reasons, the idle operating configuration does not allow unintentional switching of the contacts of the switch 6.

The control device according to the present invention remains in the idle operating configuration until a force is exerted on or applied to said thrusting means 3, in particular until a force is applied to said key 1 of the push-button that comprises the device of the present invention.

Figure 4:
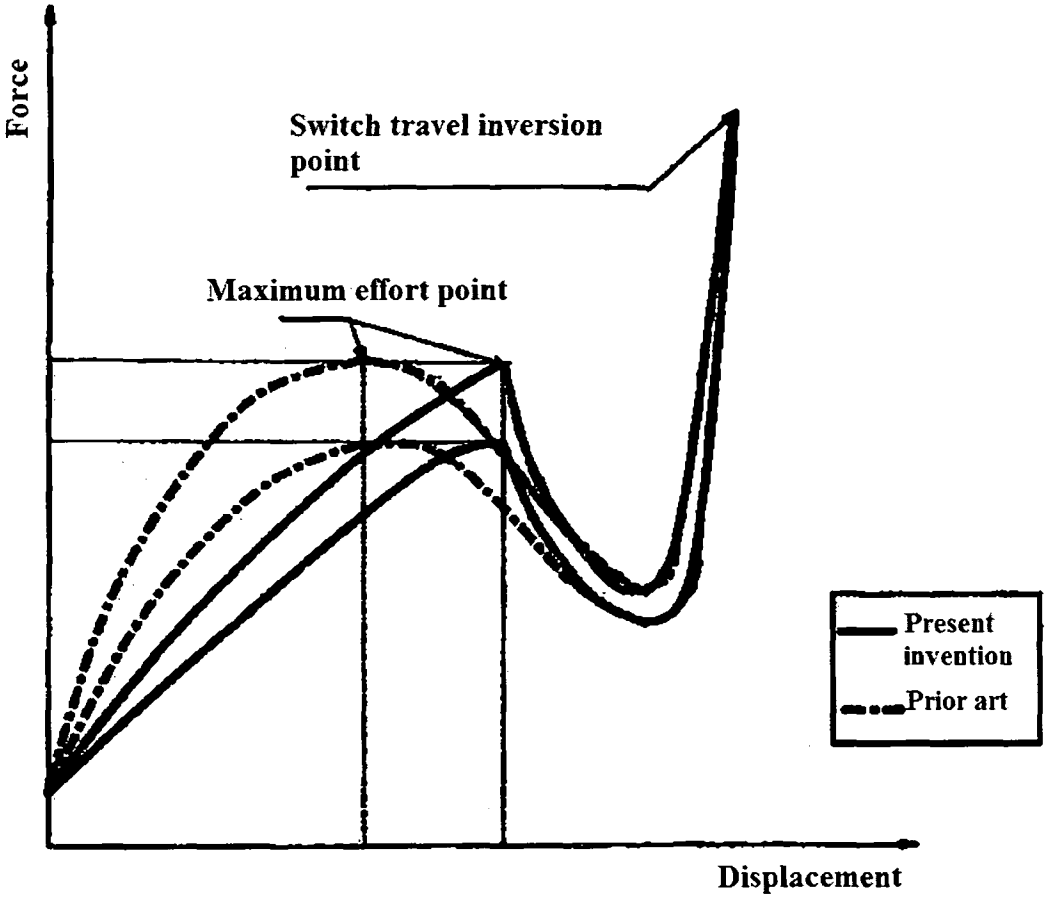
FIG. 4 shows the force/displacement graph of the device according to the present invention, compared with the force/displacement graph of a prior-art device.

FIG. 4 shows the force/displacement curve of the device according to the present invention, in comparison with the curve of prior-art devices using a simple silicone dome.

The exertion of a force on the thrusting means 3 causes the device to get into the loading operating configuration prior to reaching the switching operating configuration.

In this latter operating configuration, the force exerted on the thrusting means 3 is not directly transmitted to the actuating means 5 to compress the silicone dome 7; instead, the energy is accumulated by the elastic means 4, which will thus be compressed. This behaviour translates into a linear initial section of the force/displacement graph, the curve showing a reduced slope compared to prior-art devices.

Said compression of the elastic means 4 goes on until a predetermined applied force value is reached. Furthermore, said applied force value corresponds to a displacement of the control device at which the interspace between the thrusting means 3 and the actuating means 5, generated by the elastic means 4, is substantially null, because the elastic means 4 is compressed and therefore reduces the interspace between the two means (5, 3), as shown by way of example in FIG. 1B.

In the preferred embodiment of the device according to the present invention, when the force continues to be applied to the thrusting means 3, the same force being applied is directly transferred to the actuating means 5, which is in contact therewith. The force directly applied to the actuating means 5 is in turn transmitted to the silicone dome 7, which will collapse when a predetermined level of force applied to the dome 7 is reached, thereby bringing the device of the present invention into the switching operating configuration.

In an alternative embodiment, the thrusting means 3 remains at a distance from the actuating means 5, although it still allows the force to be transmitted to the actuating means 5 through the elastic means 4, in order to compress the dome 7 until the latter collapses.

This behaviour translates, in the force/displacement graph shown in FIG. 4, into a greater displacement of the device, the applied force being equal, thus improving the feeling of the device.

Following the collapse of said at least one dome 7, the elastic means 4 can extend towards said switch 6, thereby releasing the energy accumulated while in the loading operating configuration.

The extension of the elastic means 4, caused by the collapse of the dome 7, releases the accumulated energy towards said actuating means 5, thus increasing the speed at which it causes the silicone dome 7 to collapse and the speed at which it acts upon the switch 6.

This behaviour translates, in the force-displacement graph, into a delayed snap point or collapse point of the silicone dome 7, and, most importantly, into a very quick transition from maximum to minimum reaction of the silicone dome 7 itself.

The energy released by the extension of the elastic means 4 causes the actuating means 5 to be subjected to such an acceleration as to rapidly get into the switching operating configuration, wherein the dome 7 has totally collapsed, even without any further movement of the thrusting element 3. In this operating configuration, the actuating means 5 has arrived at the end of its travel, thus switching the switch 6, as shown by way of example in FIG. 1C. When the dome 7 comes in contact with the circuit 8, the travel of the device according to the present invention is stopped, corresponding to commutation of the switch 6.

The subsequent additional travel of the thrusting means 3 is absorbed again by the elastic means 4 with no damage to either the switch 6 or the device of the present invention.

Said acceleration while changing from the loading operating configuration to the switching operating configuration ensures a correct changeover of the switch 6, even though the mechanical characteristics of the switch 6 may cause much dispersion of the contact point of the switch itself.

When no force is applied to the thrusting means 3 anymore, the device according to the present invention returns into the idle operating configuration thanks to the elastic energy of the silicone dome 7. The return curve, shown in FIG. 4, shows substantially linear sections.

Any surplus energy generated by the return of the silicone dome 7 is absorbed by the elastic means 4, thus making the last section of the force/displacement curve linear and avoiding any resonance phenomena in the device itself, since the residual energy is quickly attenuated.

In the preferred embodiment, shown in FIGS. 1A-1C, 2 and 3, said actuating means 5 comprises at least one first contact portion 53, adapted to act upon said at least one switch 6, and at least one striker portion 54, adapted to strike against two silicone domes 7. Said two silicone domes 7 are so arranged as to balance the movement of the actuating means 5 during the transition between the loading operating configuration and the switching operating configuration.

Said device allows to eliminate any uncertainty as to the switching instant of the switch 6, even if the same switch 6 has high intrinsic switching-instant or contact-point uncertainty.

REFERENCE NUMERALS

Key 1
Central element 1*a*
Cover 1*b*
Recess 1C
Supporting structure 11
Cavity 110
Rails 111
External covering element 2
Thrusting means 3
First guides 31
Fastening portion 32
Striker portion 33
Elastic means 4
Actuating means 5
Second guides 50
Housing 51
Cavity 52
Centering means 521
Contact portion 53
Striker portion 54
Switch 6
Outer casing 61
Push-button 62
Conductive portion 66
Silicone dome 7
Silicone mat 71
Printed circuit board 8
Pins 9
Connector 10
Vertical axis "Z"

The invention claimed is:

1. A switch control device comprising:

at least one silicone dome;

at least one actuator acting upon the at least one silicone dome closing and opening electric contacts of at least one switch, the at least one switch being distinct from the silicone dome;

the at least one actuator is moved by a force along a vertical axis exerted by a thrusting element through at least one elastic element between the thrusting element and the at least one actuator;

upon application of the force the at least one elastic element is compressed by the thrusting element accumulating energy; upon release of the accumulated energy the at least one dome collapses and activates the switch;

the wherein the control device extends substantially vertically along the vertical axis;

wherein:

the thrusting element comprises first guides for sliding along rails;

the actuator comprises second guides for sliding along the rails.

2. A switch control device comprising:

at least one silicone dome;

at least one actuator acting upon the at least one silicone dome closing and opening electric contacts of at least one switch, the at least one switch being distinct from the silicone dome;

a thrusting element;

the at least one actuator is moved by a force along a vertical axis exerted by the thrusting element through at least one elastic element between the thrusting element and the at least one actuator;

upon application of the force, the at least one elastic element is compressed by the thrusting element and accumulates energy; upon release of the accumulated energy the at least one dome collapses activating the switch;

the control device extends substantially vertically along the vertical axis;

the at least one elastic element is made of silicone; and the at least one elastic element is positioned in a housing of the actuator.

3. The device according to claim 2, wherein the housing has a section substantially similar to a section of the elastic element.

4. A switch control device comprising:

at least one silicone dome;

at least one actuator, acting upon the at least one silicone dome, closing and opening electric contacts of at least one switch, the at least one switch being distinct from the silicone dome;

the at least one actuator is moved by a force along a vertical axis exerted by a thrusting element through at least one elastic element between the thrusting element and the at least one actuator, wherein upon application of force, the at least one elastic element is compressed by the thrusting element, accumulating energy, upon release of the accumulated energy the at least one dome collapses and activates the switch;

wherein extension of the elastic element towards the switch as the at least one dome element collapses releases accumulated energy towards the actuator and increases action speed on the switch.

5. The device according to claim 4, wherein said at least one elastic element is at least one coil spring.

6. The device according to claim 4, wherein:

said thrusting element comprises first guides for sliding along rails;

said actuator comprises second guides for sliding along said rails.

7. The device according to claim 1, wherein said switch is integrated into the control device, comprised in a silicone dome.

8. A push-button for electronic circuits, comprising a switch control device according to claim 1.

9. The device according to claim 1, in which said elastic element is interposed between the actuator and the thrusting element.

10. The device according to claim 4, wherein said switch is a separate electric device comprising an outer casing and a push-button.

11. The device according to claim 10, wherein said actuator comprises at least one first contact portion for acting upon said at least one switch, and at least one striker portion for striking against said at least one silicone dome.

12. The device according to claim 4, wherein said at least one elastic element is made of silicone.

13. The device according to claim 12, wherein said at least one elastic element has a circular shape.

14. The device according to claim 12, wherein said at least one elastic element is positioned in a housing of the actuator.

15. The device according to claim 14, wherein said housing has a section which is substantially similar to a section of said elastic element.

* * * * *